US007976145B2

(12) United States Patent
Hara

(10) Patent No.: US 7,976,145 B2
(45) Date of Patent: Jul. 12, 2011

(54) RECORDING METHOD

(75) Inventor: Keiji Hara, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 323 days.

(21) Appl. No.: 12/410,212

(22) Filed: Mar. 24, 2009

(65) Prior Publication Data

US 2009/0244158 A1 Oct. 1, 2009

(30) Foreign Application Priority Data

Mar. 25, 2008 (JP) ..... 2008-078861
Jan. 5, 2009 (JP) ..... 2009-000127

(51) Int. Cl.
*B41J 2/17* (2006.01)

(52) U.S. Cl. ..... 347/98; 347/96; 347/7

(58) Field of Classification Search ..... 347/5, 7, 347/14, 19, 96, 98
See application file for complete search history.

(56) References Cited

U.S. PATENT DOCUMENTS 5,898,443 A 4/1999 Yoshino et al.
6,435,638 B1 * 8/2002 Wilson et al. ..... 347/7
6,655,797 B2 * 12/2003 Smith et al. ..... 347/98
6,940,618 B2 9/2005 Kinas
7,530,684 B2 * 5/2009 Yamanobe ..... 347/96
2009/0244145 A1 10/2009 Hara

FOREIGN PATENT DOCUMENTS

| | | |
|---|---|---|
| JP | 64-044756 | 2/1989 |
| JP | 07-009728 | 1/1995 |
| JP | 11-240146 | 9/1999 |
| JP | 2004-142269 | 5/2004 |
| JP | 2006-027220 | 2/2006 |
| JP | 2006-095768 | 4/2006 |
| JP | 2007-118373 | 5/2007 |
| JP | 2008-012712 | 1/2008 |

OTHER PUBLICATIONS

U.S. Appl. No. 12/410,162, Aug. 30, 2010, Office Action.

* cited by examiner

*Primary Examiner* — Lam S Nguyen
(74) *Attorney, Agent, or Firm* — Workman Nydegger

(57) ABSTRACT

A recording method is provided for recording images based on image data on a recording area of a recording medium using a first color liquid and a second color liquid containing coloring material and a colorless liquid not containing the coloring material, the recording medium being transported along a predetermined transport direction, the method including: a consumption amount calculation step of calculating a consumption amount of the first color liquid consumed when recording the images based on the image data on the recording medium, the consumption amount being obtained by subtracting the content of the coloring material from a total consumption amount of the first color liquid, and the consumption amount being calculated for each unit area of the recording area of the recording medium.

2 Claims, 8 Drawing Sheets

RECORDING METHOD

BACKGROUND

1. Technical Field

The present invention relates to a recording method for recording images or the like on a recording medium using liquid such as ink.

2. Related Art

As a recording apparatus that performs a recording process on a recording medium using liquid, an ink jet recording apparatus (hereinafter, referred to simply as "recording apparatus") that ejects ink onto a recording sheet is generally known. Such a recording apparatus is provided with a transport mechanism that transports the recording sheet along a transport direction and a recording head that ejects ink onto the recording sheet being transported to an inside of the apparatus by the transport mechanism. Upon receiving image data from a host computer connected to the recording apparatus, the recording apparatus causes the recording head to eject various types of ink onto the recording sheet so that images based on the image data are recorded on a recording area of the recording sheet.

The recording sheet on which images are recorded is likely to be expanded or contracted by the influence of an installation atmosphere (particularly, humidity) of the recording apparatus, the ejected ink or the like. Moreover, in some cases, the recording sheet is transported by the transport mechanism in a state of being oblique to the transport direction. In such a case, the recording head may be unable to eject ink at an appropriate position of the recording sheet. As a solution to such a problem, JP-A-2004-142269 proposes a recording method.

According to the recording method disclosed in JP-A-2004-142269, when recording of images on the recording sheet is completed for the first page, a gap (i.e., a margin gap) between an end of a recording area of the recording sheet on which the recording has been performed and an end of the recording sheet is measured, and a difference between the measured gap and a predetermined gap which is preliminarily set as a recording condition. When images are recorded on the second or subsequent page of the recording sheet, the recording is performed on the recording sheet in a state where the ejection state of ink on the recording sheet is corrected in accordance with the difference. Therefore, even when the recording sheet is expanded or contracted or the recording sheet is transported in an oblique state, images are appropriately recorded on the recording sheet.

However, among recording apparatuses, there is known a line head type recording apparatus in which a plurality of recording units (for example, two recording units) having a length equal to or greater than the length of the recording sheet in the width direction is arranged to be separated from each other in the transport direction. Among these recording units, an upstream recording unit disposed on the upstream side in the transport direction is configured to be able to eject first types of ink (for example, cyan ink and magenta ink) and a downstream recording unit disposed on the downstream side in the transport direction is configured to be able to eject second types of ink (for example, yellow ink and black ink). In such a recording apparatus, after the first types of ink are ejected from the upstream recording unit onto the recording sheet, the second types of ink are appropriately ejected from the downstream recording unit onto the recording sheet so that the landing position of the second types of ink overlaps with the landing position of the first types of ink from the upstream recording unit.

At this time, portions of the recording sheet on which the ink has been landed may be locally expanded due to the ink ejected onto the recording sheet by the upstream recording unit. In such a case, a positional deviation may occur which is a positional difference between the landing position of the ink from the upstream recording unit and the landing position of the ink from the downstream recording unit which ejects ink later than the upstream recording unit. To solve such a problem, a technique that correct at least one of the landing position of the ink from the upstream recording unit and the landing position of the ink from the downstream recording unit to thereby achieving an improvement in the quality of images recorded on the recording sheet has recently been proposed.

However, the content of moisture (i.e., solvent or dispersion medium) in the recording sheet to which ink is ejected may differ at each position where the ink ejection states are different. Therefore, an expansion state of a portion of the recording sheet in which the moisture content is large may differ from an expansion state of a portion in which the moisture content is small. As a result, in the recording sheet for which recording has been performed, the degree of expansion/contraction resulting from vaporization of the moisture may become uneven at each position of the recording sheet. Since the degree of expansion/contraction differs at each position of the recording sheet, in order to correct the landing positions of the respective types of ink in such recording sheet, it is necessary to perform very complicated control.

SUMMARY

An advantage of some aspects of the invention is that it provides a recording method capable of achieving a uniform degree of expansion/contraction on the entire portions of a recording medium on which recording has been performed.

According to an aspect of the invention, there is provided a recording method for recording images based on image data on a recording area of a recording medium using a first color liquid and a second color liquid containing coloring material and a colorless liquid not containing the coloring material, the recording medium being transported along a predetermined transport direction, the method including: a consumption amount calculation step of calculating a consumption amount of the first color liquid consumed when recording the images based on the image data on the recording medium, the consumption amount being obtained by subtracting the content of the coloring material from a total consumption amount of the first color liquid, and the consumption amount being calculated for each unit area of the recording area of the recording medium; a colorless liquid supply amount calculation step of calculating a difference between the consumption amount of the first color liquid calculated in the consumption amount calculation step for each unit area and a predetermined moisture content and using the difference as a supply amount of the colorless liquid for each unit area; a first supply step of supplying the first color liquid corresponding to the consumption amount calculated in the consumption amount calculation step to the recording medium while supplying the colorless liquid corresponding to the supply amount calculated in the colorless liquid supply amount calculation step to the recording medium; and a second supply step of supplying the second color liquid to the recording medium after execution of the first supply step.

According to the above configuration, the sum of the consumption amount of the first color liquid and the supply amount of the colorless liquid is identical for each unit area of the recording area of the recording medium. In such a state, the second color liquid is supplied to the recording area of the recording medium. Owing to such a configuration, it is possible to achieve a uniform degree of expansion/contraction on the entire portions of the recording medium on which recording has been performed.

In the recording method according to the above aspect of the invention, the recording method further includes a heating step of heating the recording medium to which the first color liquid and the colorless liquid are supplied in the first supply step, and in the second supply step, the second color liquid is supplied to a portion of the recording medium located at a position where the portion has been heated in the heating step.

According to the above configuration, the first color liquid and the colorless liquid supplied onto the recording medium in the first supply step are vaporized to some degree. Owing to such a configuration, it is possible to suppress blurring of the first color liquid before the second color liquid is supplied to the recording medium in the second supply step.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording method and a recording system according to an embodiment of the invention will be described with reference to FIGS. 1 to 8.

Figure 1A:
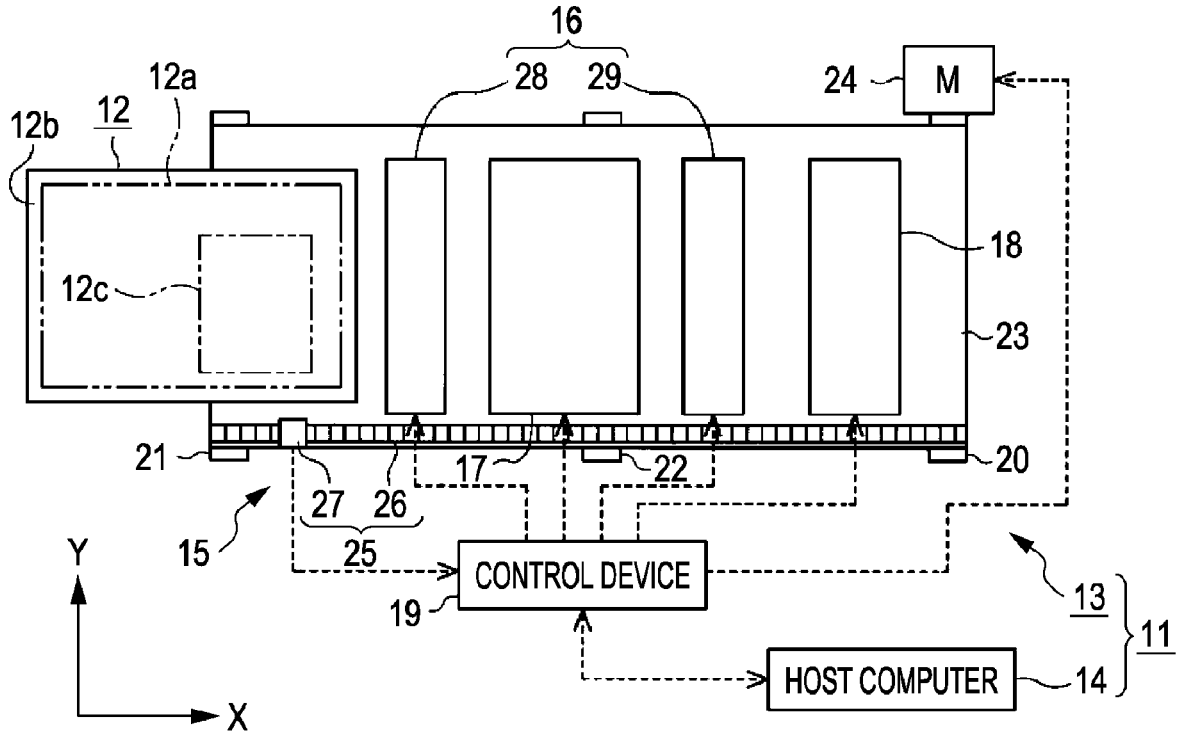
FIG. 1A is a schematic plan view of a recording system according to an embodiment of the invention.
Figure 1B:
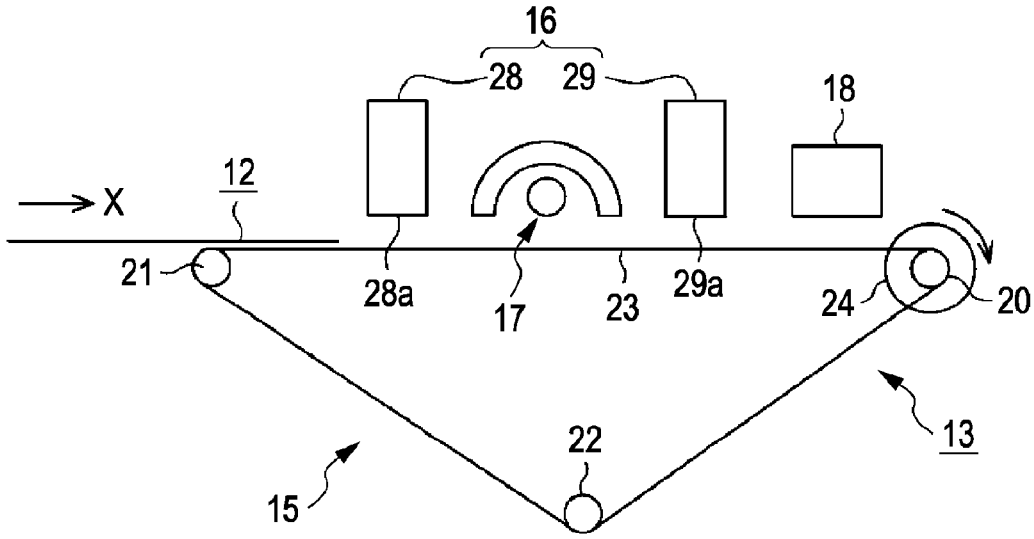
FIG. 1B is a schematic side view of an ink jet recording apparatus.

As illustrated in FIGS. 1A and 1B, a recording system 11 according to the present embodiment includes an ink jet recording apparatus 13 (hereinafter, referred to simply as "recording apparatus") that ejects (supplies) aqueous ink as liquid to a recording sheet 12 as recording medium and a host computer 14 that is capable of transmitting and receiving various types of information (image data or the like) to/from the recording apparatus 13. The recording apparatus 13 is provided with a transport mechanism 15 as a transport unit for transporting the recording sheet 12 along a predetermined transport direction X and a recording mechanism 16 as a recording unit capable of supplying ink to the recording sheet 12 being transported to the transport mechanism 15. The recording apparatus 13 is also provided with a heater 17 as a heating unit for vaporizing moisture of the ink landed on the recording sheet, a scanner 18 capable of scanning images or the like recorded on the recording sheet 12, and a control device 19 for controlling an overall operation of the recording apparatus 13.

The transport mechanism 15 is provided with a driving roller 20 disposed on a downstream side (the right side in FIGS. 1A and 1B) in the transport direction X, a driven roller 21 disposed on a upstream side (the left side in FIGS. 1A and 1B) in the transport direction X, and a tension roller 22 disposed at an approximately central position between the driving roller 20 and the driven roller 21 while being located on the lower side in FIG. 1B of the respective rollers 20 and 21. The transport mechanism 15 is also provided with an endless transport belt 23 that is wound around the respective rollers 20 to 22 and a transport motor 24 for rotating the driving roller 20 in a predetermined rotation direction (the direction denoted by the arrow in FIG. 1B). The transport belt 23 transports the recording sheet 12 in the transport direction X when the driving roller 20 is rotated in the predetermined rotation direction by the transport motor 24.

Further, the transport mechanism 15 is also provided with a linear encoder 25 (which is a magnetic linear encoder in the present embodiment) for measuring a driving speed of the transport belt 23, the position of the recording sheet 12 on the transport belt 23, and the like. The linear encoder 25 is provided with a magnetic linear scale 26 which is formed around the entire circumference of the transport belt 23. On a strip-like magnetic recording layer of the magnetic linear scale 26, a magnetic pattern is formed at a constant pitch in the circumferential direction of the magnetic linear scale 26. Moreover, a magnetic sensor 27 for reproducing the magnetic pattern of the magnetic linear scale 26 is formed in the proximity (on a front side of the magnetic linear scale 26 in FIG. 1A) of the magnetic linear scale 26. The magnetic sensor 27 outputs a detected encoder signal to the control device 19.

The recording mechanism 16 is provided with a plurality of recording heads 28 and 29 as recording units (in the present embodiment, two recording heads are provided) which is arranged to be separated from each other in the transport direction X. The recording heads 28 and 29 are formed such that a respective length thereof in a width direction Y perpendicular (crossing) the transport direction X is larger than the length of the recording sheet 12 in the width direction Y. Moreover, among these recording heads 28 and 29, the upstream recording head 28 (uppermost-side recording unit) as a first recording unit disposed on the upstream side in the transport direction X is configured to be able to eject magenta ink and cyan ink as a first color liquid among various types of ink (four types of ink is used in the present embodiment) as a color liquid containing coloring material, onto an entire area of a recordable area 12*a* (an area surrounded by the two-dot chain line in FIG. 1A) of the recording sheet 12. On the other hand, the downstream recording head (lowermost recording unit) as a second recording unit disposed on the downstream side in the transport direction X is configured to be able to eject yellow ink and black ink as a second color liquid onto an entire area of the recordable area 12*a* of the recording sheet 12. Moreover, the respective recording heads 28 and 29 are configured to be able to eject clear ink (colorless and transparent ink) as a colorless liquid not containing the coloring material onto an entire area of the recordable area 12*a* of the recording sheet 12.

Figure 2:
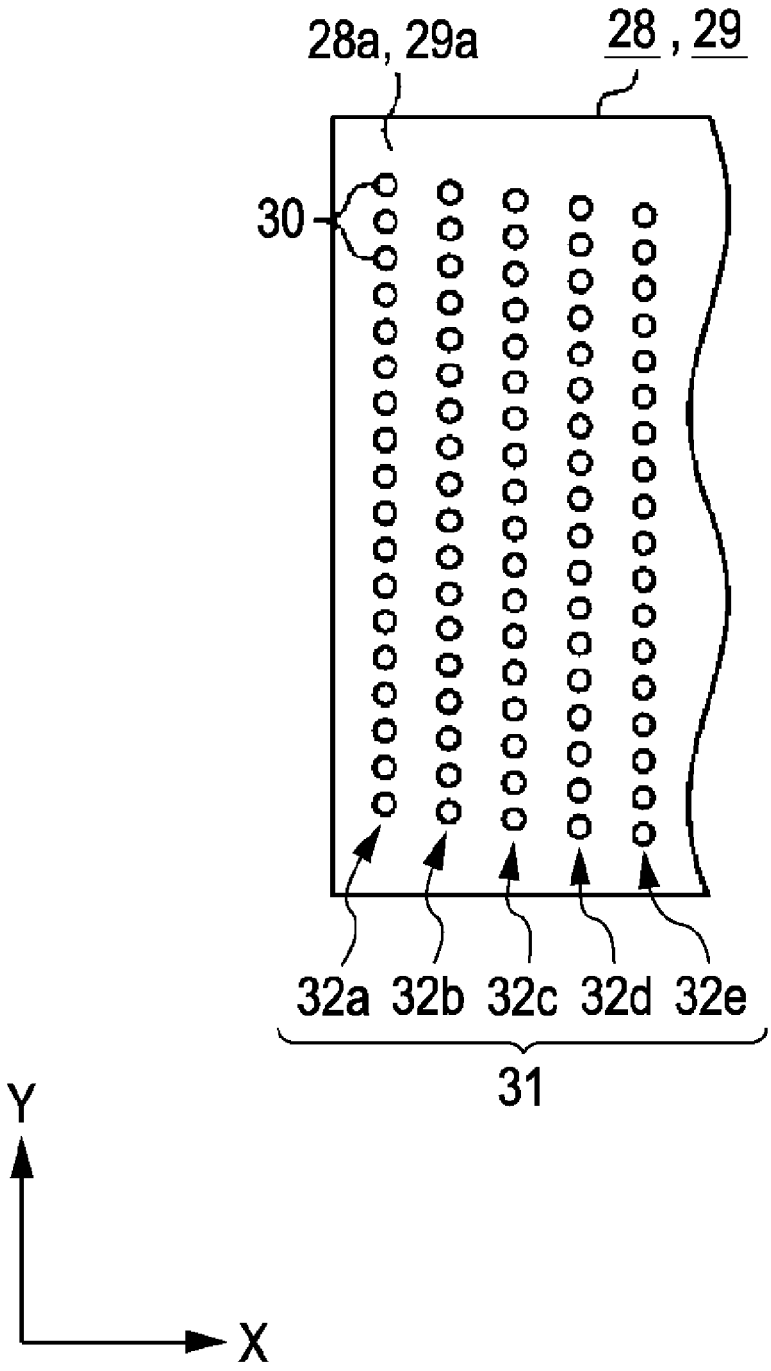
FIG. 2 is a plan view schematically illustrating a portion of a nozzle forming surface.

As illustrated in FIG. 2, opposing surfaces of the respective recording heads 28 and 29 being opposed to the recording sheet 12 being transported by the transport mechanism 15 are configured as nozzle forming surfaces 28*a* and 29*a*, respectively, on which a number of nozzle openings 30 are formed. On the respective nozzle forming surfaces 28*a* and 29*a*, nozzle groups of each type of ink (only a magenta ink nozzle group 31 is illustrated in FIG. 2) are formed along the transport direction X, respectively. In the respective nozzle forming surfaces 28*a* and 29*a*, a clear ink nozzle group is disposed to be located closer to the downstream side in the transport direction X than other nozzle groups (than the magenta ink nozzle group 31 or a cyan ink nozzle group in the case of the nozzle forming surface 28*a*).

The magenta ink nozzle group 31 has a configuration in which a plurality of nozzle arrays 32*a*, 32*b*, 32*c*, 32*d*, and 32*e* (five arrays in FIG. 2), each formed of a plurality of nozzle openings 30 arranged at an equal interval along the width direction Y, is arranged at an equal interval along the transport direction X. The neighboring nozzle arrays 32*a* to 32*e* in the transport direction X are in such a relation that the nozzle opening 30 disposed uppermost in FIG. 1 among the respective nozzle openings 30 constituting the nozzle array disposed on the upstream side in the transport direction X is located slightly higher in FIG. 1 than the nozzle opening 30 disposed uppermost in FIG. 1 among the respective nozzle openings 30 constituting the nozzle array disposed on the downstream side in the transport direction X. That is, the respective nozzle openings 30 constituting the magenta ink nozzle group 31 are arranged such that they are located at different positions in the width direction Y. Since nozzle groups of other ink have the same configuration as the magenta ink nozzle group 31, detailed description thereof will be omitted.

As illustrated in FIGS. 1A and 1B, the heater 17 is disposed at an intermediate position of the respective recording heads 28 and 29 in the transport direction X. Moreover, the heater 17 is driven such that all the same amount of heat is applied to the recording sheet 12 during recording on the recording sheet 12.

Figure 3:
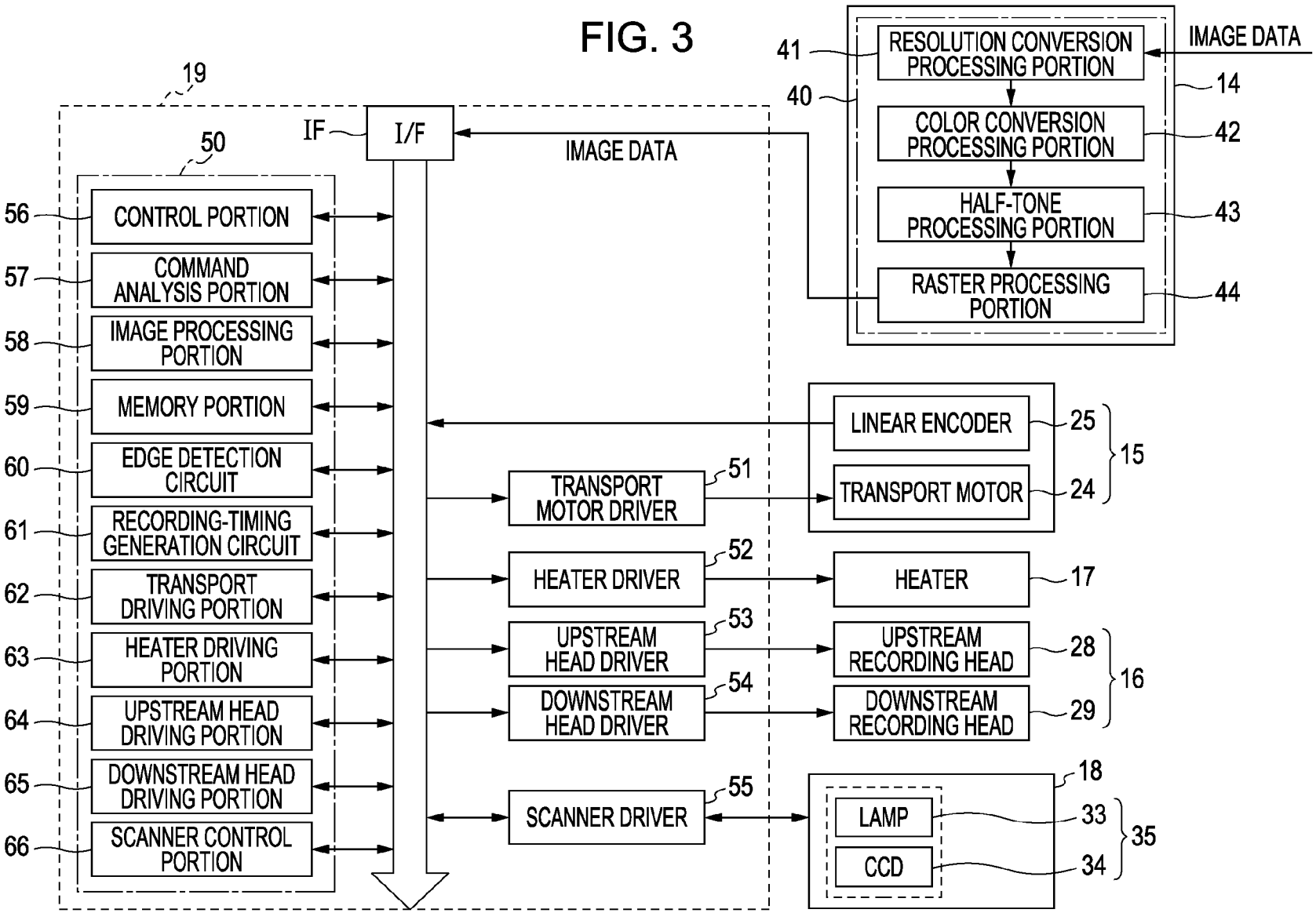
FIG. 3 is a block circuit diagram illustrating an electrical configuration according to the present embodiment.

The scanner 18 is disposed to be located closer to the downstream side in the transport direction X than the downstream recording head 29. As illustrated in FIG. 3, the scanner 18 is provided with a scan unit 35 that includes a lamp 33 for irradiating light to the recording sheet 12 and a charge coupled device (CCD) 34 for acquiring an image or the like of the recording sheet 12 as recording information. When the scanner 18 performs a scan operation for acquiring recording information from the recording sheet 12 transported thereto by the transport mechanism 15, light is irradiated from the lamp 33 of the scan unit 35 onto the recording sheet 12, and light reflected from the recording sheet 12 is detected by the CCD 34, whereby an image (which is a later-described reference mark) of the recording sheet 12 is acquired as the recording information. Thereafter, the scanner 18 transfers the acquired recording information based on the reference mark of the recording sheet 12 to the control device 19.

As illustrated in FIG. 3, in the host computer 14, a printer driver 40 is implemented by a CPU (not illustrated) of the host computer 14 and program. The printer driver 40 is provided with a resolution conversion processing portion 41, a color conversion processing portion 42, a half-tone processing portion 43, and a raster processing portion 44. The resolution conversion processing portion 41 performs a resolution conversion process of converting a resolution of image data of an image to be recorded on the recording sheet 12 to a recording resolution (also referred to as "printing resolution") of the recording apparatus 13.

The color conversion processing portion 42 performs a color conversion process upon receipt of RGB image data from the resolution conversion processing portion 41. The color conversion process is a process of converting image data formed by gradation values of R (red), G (green) and B (blue) to data of gradation values of each color of C (cyan) M (Magenta), Y (yellow) and K (black) used in the recording apparatus 13, and such a process is performed by referring to a non-illustrated color conversion table (look-up table). The color conversion table is conversion table data used for expressing a color expressed by a combination of respective gradation values of R, G and B using a combination of respective gradation values of C, M, Y and K.

The half-tone processing portion 43 performs a half-tone process (gradation-number conversion process) upon receipt of the color-converted CMYK image data from the color conversion processing portion 42. In the present embodiment, the color-converted image data are expressed as data having 256 gradations for each color. To the contrary, the recording apparatus 13 is able to adopt only one of four states, three states for "three types of dot areas (ink ejection amounts)" when forming dots using color ink and one state for "dot is not formed." That is, the recording apparatus 13 is able to express only four gradations for one dot. The half-tone processing portion 43 converts the RGB image data having 256 gradations to CMYK image data expressed with four gradations which can be expressed by the recording apparatus 13, namely, dot data having four gradations.

The raster processing portion 44 performs an interlace process upon receipt of the dot data for each color ink dot from the half-tone processing portion 43. The interlace process is a process of interlacing the dot data of four gradations into an order to be transferred to the recording apparatus 13 considering the forming order of the dots. Then, the raster processing portion 44 outputs the image data having subjected to the interlace process to the recording apparatus 13.

Next, an electrical configuration of the recording apparatus 13 according to the present embodiment will be described with reference to FIGS. 3 to 5.

As illustrated in FIG. 3, the control device 19 of the recording apparatus 13 is provided with a control unit 50 (a portion surrounded by the one-dot chain line in FIG. 2) configured by a digital computer or the like, a transport motor driver 51 for driving the transport motor 24, and a heater driver 52 for driving the heater 17. The control device 19 is further provided with a upstream head driver 53 for driving the upstream recording head 28, a downstream head driver 54 for driving the downstream recording head 29, and a scanner driver 55 for driving the scanner 18.

The control unit 50 is configured to include a CPU, a ROM, a RAM, an ASIC (Application Specific Integrated Circuit), a nonvolatile memory (for example, EEPROM), and the like. In addition, the control unit 50 is provided with a control portion 56, a command analysis portion 57, an image processing portion 58, a memory portion 59, an edge detection circuit 60, a recording-timing generation circuit 61, a transport driving portion 62, a heater driving portion 63, a upstream head driving portion 64, a downstream head driving portion 65, and a scanner control portion 66, which are functional portions implemented by at least one of hardware and software, respectively.

The control portion 56 is configured by a CPU and an ASIC. Upon receiving recording data from the host computer 14 via an interface IF, the control portion 56 outputs a control instruction to the transport driving portion 62 to transport the recording sheet 12 to the transport mechanism 15. Moreover, the control portion 56 outputs a control instruction to the heater driving portion 63 to heat the recording sheet 12 with the heater 17 (more specifically, to vaporize ink landed on the recording sheet 12).

The command analysis portion 57 analyzes (interprets) a command contained in the recording data received from the host computer 14 to thereby generate an intermediate code.

Then, the command analysis portion 57 stores the generated intermediate code in a non-illustrated intermediate buffer.

The image processing portion 58 converts the intermediate code stored in the intermediate buffer to bitmap data (gradation data) in which recording dots (printing dots) are expressed in gradation values. Then, the image processing portion 58 expands the converted bitmap data onto the memory portion 59.

The memory portion 59 has a memory area in which the bitmap data converted in the image processing portion 58 are expanded. Then, the bitmap data in the memory portion 59 are appropriately read into the respective head driving portions 64 and 65.

The edge detection circuit 60 is a circuit for generating a recording timing signal PTS (see FIG. 4) that determines ejection timing of ink from the nozzle openings 30 of the respective recording heads 28 and 29. As illustrated in FIGS. 4 and 5, upon receiving the encoder signal from the magnetic sensor 27 of the linear encoder 25, the edge detection circuit 60 generates pulses whenever rising edges of the encoder signal are detected to thereby output a reference pulse signal RS having the same cycle as a cycle (encoder cycle) of the encoder signal to the recording-timing generation circuit 61.

Figure 4:
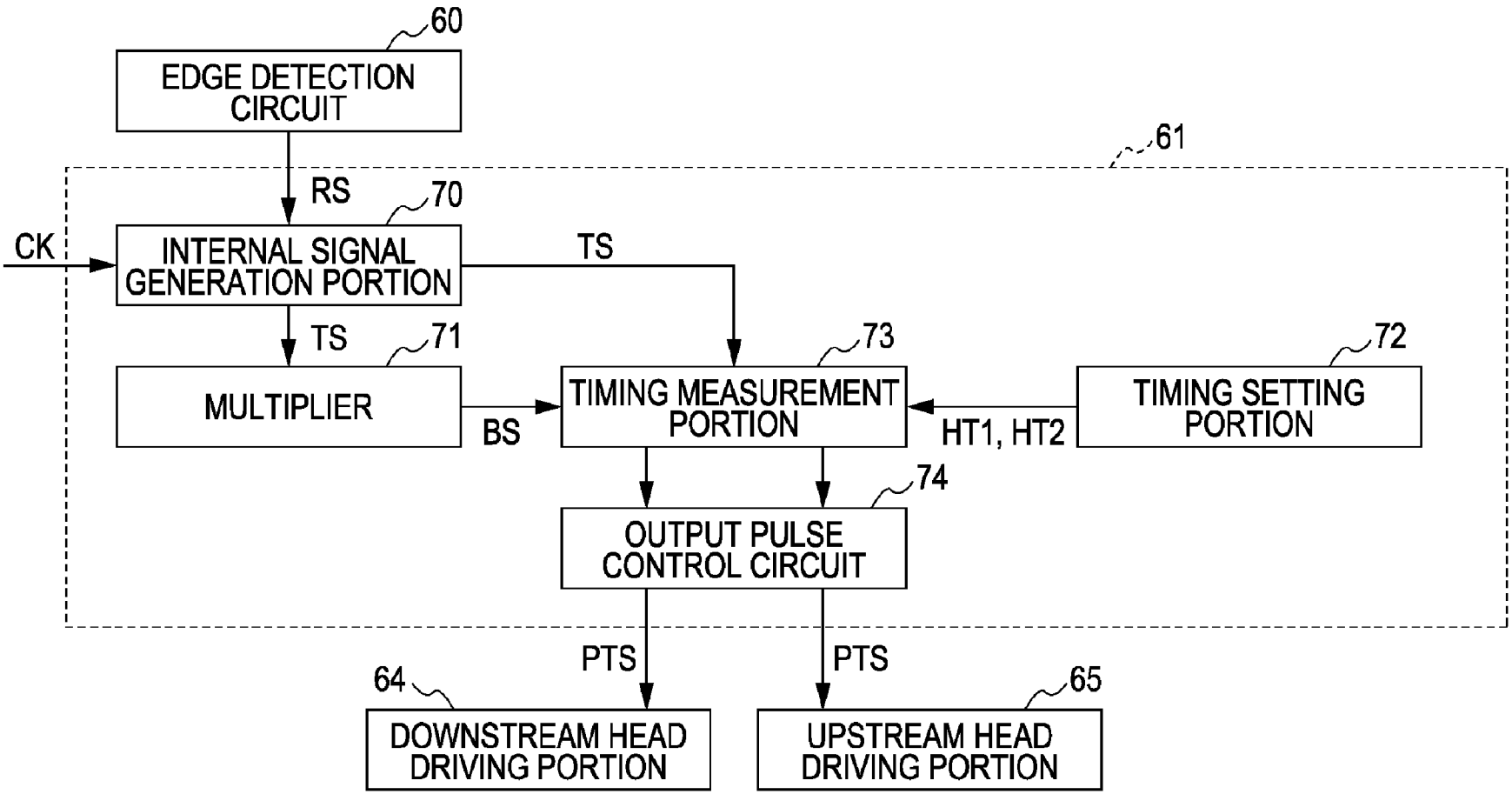
FIG. 4 is a block circuit diagram illustrating a configuration of a recording-timing generation circuit.
Figure 5:
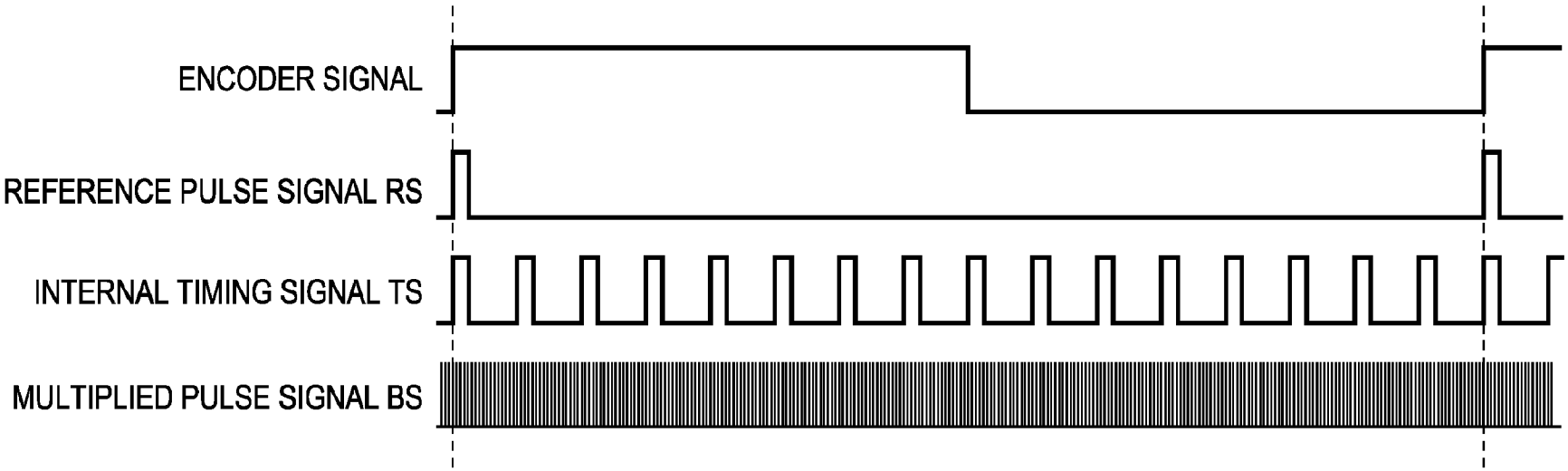
FIG. 5 is a timing chart illustrating an internal timing signal and a multiplied pulse signal.

As illustrated in FIGS. 4 and 5, the recording-timing generation circuit 61 includes an internal signal generation portion 70, a multiplier 71, a timing setting portion 72, a timing measurement portion 73, and an output pulse control circuit 74. The internal signal generation portion 70 generates a pulse signal obtained by dividing one cycle of the reference pulse signal RS by 16 as an internal timing signal TS based on the reference pulse signal RS from the edge detection circuit 60 and a clock signal CK input from a non-illustrated clock circuit. Then, the internal signal generation portion 70 outputs the generated internal timing signal TS to the multiplier 71 and the timing measurement portion 73. The multiplier 71 generates a multiplied pulse signal BS by further dividing (multiplying) one cycle of the received internal timing signal TS. Then, the multiplier 71 outputs the generated multiplied pulse signal BS to the timing measurement portion 73. The timing setting portion 72 acquires change time HT1 and HT2 of the ejection timing of ink ejected by the respective recording heads 28 and 29 based on the result of a later-described test process. Then, the timing setting portion 72 outputs the acquired change time HT1 and HT2 to the timing measurement portion 73. Here, a first change time HT1 for the upstream recording head 28 is set to "0 (zero)." On the other hand, a second change time HT2 for the downstream recording head 29 is set such that the ejection timing of ink to be landed at a position near the edge portion of the recording sheet 12 is corrected to have larger change time.

Moreover, the timing measurement portion 73 measures the ink ejection timing for each of the nozzle openings 30 based on the received internal timing signal TS, the multiplied pulse signal BS, and the change time HT1 and HT2. Specifically, the setting time for the ejection timing of ink from one nozzle opening 30, which is set based on the bitmap data expanded in the memory portion 59, is corrected by an amount corresponding to the change time HT1 and HT2. Then, the timing measurement portion 73 outputs a control instruction to the output pulse control circuit 74 after a lapse of the setting time corrected by the change time HT1 and HT2. Upon receiving the control instruction, the output pulse control circuit 74 generates the recording timing signal PTS to the respective head driving portions 64 and 65 so that ink is ejected from the nozzle opening 30 for which the ink ejection timing has arrived.

As illustrated in FIG. 3, the transport driving portion 62 controls the transport mechanism 15 via the transport motor driver 51 based on the control instruction from the control portion 56. At this time, the transport driving portion 62 controls a rotation speed or the like of the transport motor 24 in response to the encoder signal from the linear encoder 25.

Upon receiving a control instruction to heat the recording sheet 12, the heater driving portion 63 controls the heater 17 during a time when the recording sheet 12 is being transported by the transport mechanism 15.

The upstream head driving portion 64 control an ejection state of color ink from the respective nozzle openings 30 of the upstream recording head 28 based on the recording data (bitmap data) transferred via the recording-timing generation circuit 61 from the control portion 56. Moreover, the upstream head driving portion 64 controls the upstream recording head 28 so that clear ink is ejected to an entire area of the recordable area 12*a* of the recording sheet 12. Specifically, the upstream head driving portion 64 controls the upstream recording head 28 so that a larger amount of clear ink is ejected onto portions of the recordable area 12*a* of the recording sheet 12 being located at positions where color ink ejected from the upstream recording head 28 is not landed, than that ejected to portions of the recordable area being located at positions where color ink ejected from the upstream recording head 28 is landed. Furthermore, the upstream head driving portion 64 controls the upstream recording head 28 so that even at a position on which the color ink ejected from the upstream recording head 28 is landed, a larger amount of clear ink is ejected to portions of a recording area 12*c* of the recording sheet 12 where the size of dots formed by the color ink is small, than to portions of the recording area 12*c* where the size of the dots is large.

On the other hand, the downstream head driving portion 65 control an ejection state of color ink from the respective nozzle openings 30 of the downstream recording head 29 based on the recording data (bitmap data) transferred via the recording-timing generation circuit 61 from the control portion 56.

The scanner control portion 66 controls the scanner 18 so as to scan images or the like recorded on the recording sheet 12 via the scanner driver 55. Then, the scanner control portion 66 transfers the recording information acquired by the scanner 18 scanning the recording sheet 12 to the control portion 56.

Figure 6:
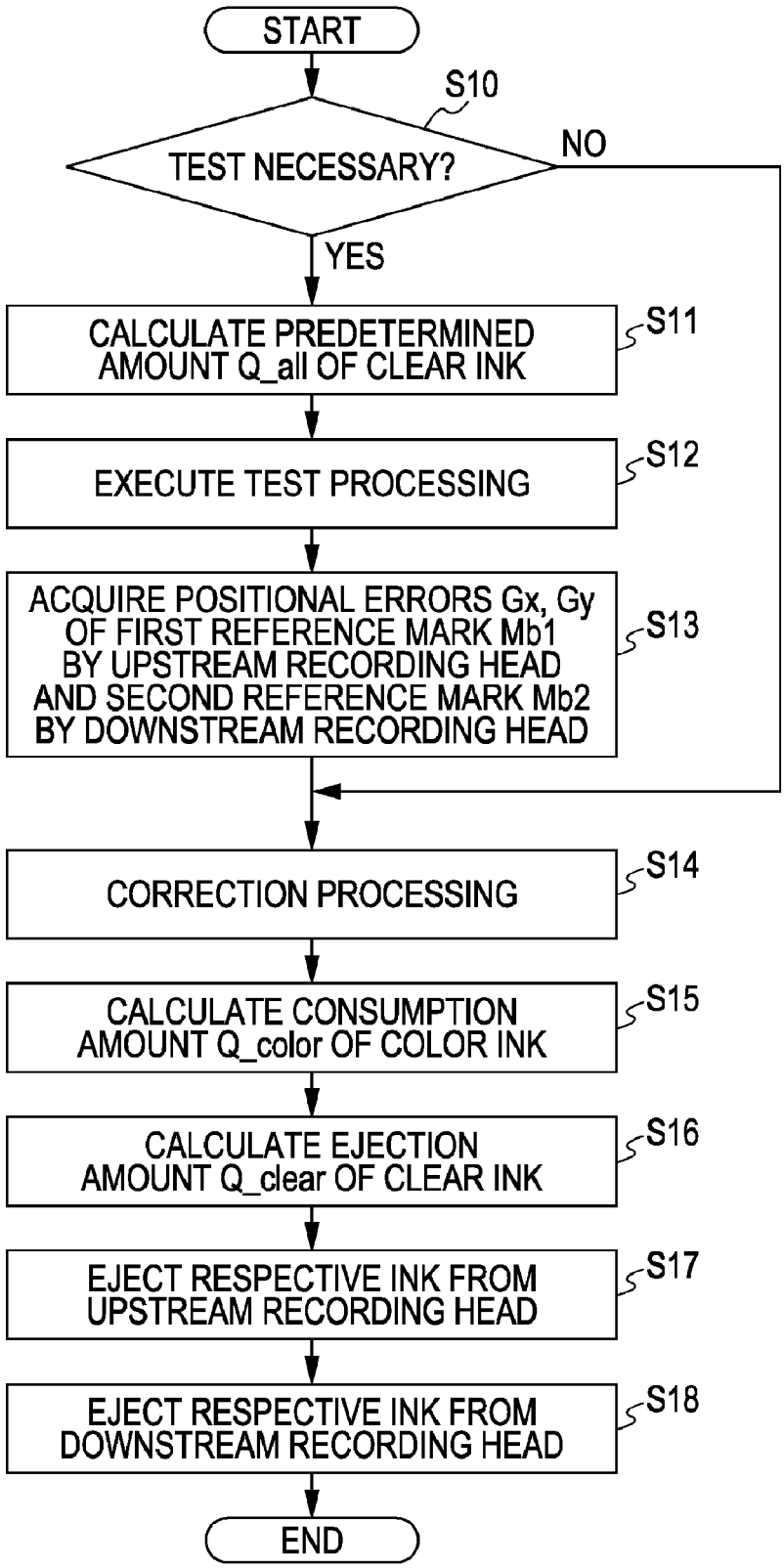
FIG. 6 is a flow chart explaining a recording processing routine according to the present embodiment.
Figure 7A:
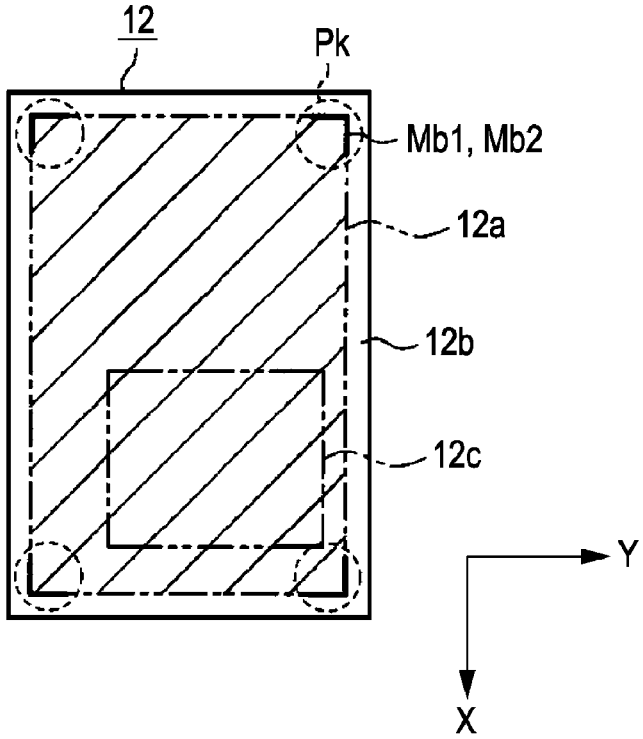
FIG. 7A is a plan view schematically illustrating a recording sheet.
Figure 7B:
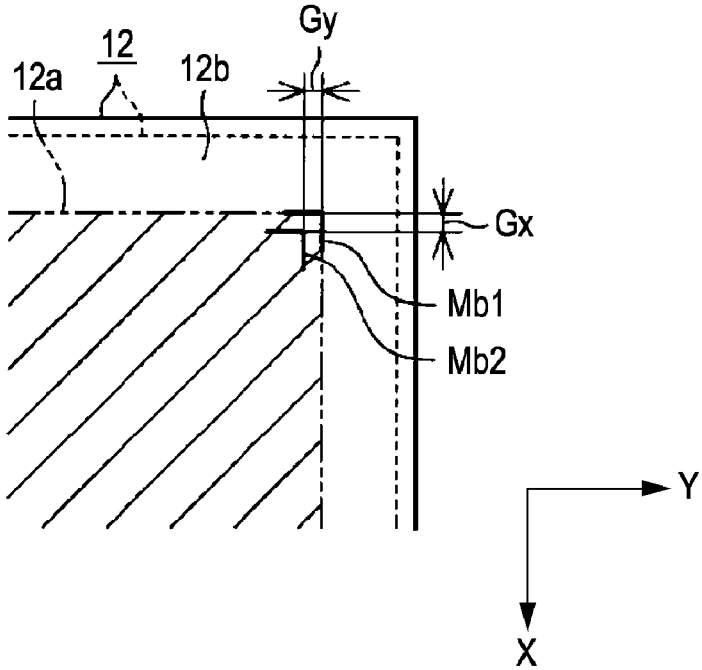
FIG. 7B is a partial enlarged view of FIG. 7A.

Next, a recording processing routine, which is executed when recording images on the recording sheet 12, and which is one of a variety of control processing routines executed by the control portion 56 according to the present embodiment, will be described with reference to the flow chart illustrated in FIG. 6 and the operational diagram illustrated in FIGS. 7A and 7B.

The control portion 56 executes a recording processing routine upon receiving image data from the host computer 14. In this recording processing routine, the control portion 56 makes a determination as to whether or not it is necessary to perform a test for acquiring a positional deviation amount between a landing position on the recording sheet 12, of ink ejected from the upstream recording head 28 and a landing position on the recording sheet 12, of ink ejected from the downstream recording head 29 (step S10). That is, when the size and type of the recording sheet 12 used in recording is changed or the temperature, humidity or the like of the recording apparatus 13 is changed, that is, when the recording condition is changed, the degree of expansion/contraction of the recording sheet 12 to which ink is ejected by the respective recording heads 28 and 29 changes. In step S10, a determination is made as to whether or not the recording condition has changed after the last test was performed. For example, when the size of the recording sheet 12 is changed, because information about the size of the recording sheet 12 is contained in the image data received from the host computer 14, the control portion 56 is able to make a determination as to whether or not the size of the recording sheet 12 used in the present recording is identical with the size of the recording sheet 12 used in the previous recording.

When a determination result in step S10 is negative, the control portion 56 determines that the recording condition is not changed from that of the last test, and the routine proceeds to later-described step S14. On the other hand, when a determination result in step S10 is positive, the control portion 56 calculates a consumption amount of clear ink as a predetermined amount Q_all when the clear ink is evenly ejected on an entire area of the recordable area 12*a* (an area surrounded by the two-dot chain line in FIG. 7A) of the recording sheet 12 used for recording images as illustrated in FIG. 7A (that is, so that an absorption amount of the clear ink for each unit area of the recordable area 12*a* is approximately equal) (step S11). Here, the recordable area 12*a* is an area which is preliminarily set for each type of the recording sheet 12, and which is surrounded by a rectangular annular non-ejection area 12*b* formed in the edge portion of the recording sheet 12 so that ink does not adhere to the transport belt 23 transporting the recording sheet 12. Moreover, the predetermined amount Q_all is the sum of the ejection amounts of ink from the respective recording heads 28 and 29 when the largest moisture content is obtained for each unit area of the recordable area 12*a* of the recording sheet 12 when various types of ink are ejected onto the recording sheet 12.

Subsequently, the control portion 56 executes a test process on the recording sheet 12 (step S12). Specifically, the control portion 56 outputs a control instruction for transporting the recording sheet 12 to the transport driving portion 62, and the transport driving portion 62 causes the transport motor driver 51 to rotate the transport motor 24 in the predetermined rotation direction. Then, the transport mechanism 15 transports the recording sheet 12 along the transport direction X at a constant speed. Moreover, the control portion 56 outputs a control instruction to the upstream head driving portion 64, the control instruction for forming a first reference mark Mb1 serving as a basis for acquisition of positional deviation amounts Gx and Gy at respective measurement positions Pk which are set at four corners of the recordable area 12*a* of the recording sheet 12. Upon receiving the recording timing signal PTS from the recording-timing generation circuit 61, the upstream head driving portion 64 allows the upstream head driver 53 to cause the upstream recording head 28 to eject magenta ink therefrom. Therefore, step S12 includes a first mark forming step.

Subsequently, the control portion 56 outputs a control instruction to the upstream head driving portion 64 to eject clear ink corresponding the predetermined amount Q_all calculated in step S11 onto an entire area of the recordable area 12*a* of the recording sheet 12. Then, upon receiving the recording timing signal PTS from the recording-timing generation circuit 61, the upstream head driving portion 64 allows the upstream head driver 53 to cause the upstream recording head 28 to eject the clear ink therefrom. That is, at positions of the recordable area 12*a* of the recording sheet 12 being located along the transport direction X where the first reference marks Mb1 are formed, the clear ink is ejected after the first reference marks Mb1 are formed. Therefore, step S12 includes a colorless liquid supply step of ejecting the clear ink evenly onto an entire area of the recordable area 12*a* of the recording sheet 12.

Moreover, the control portion 56 individually outputs a control instruction to the respective head driving portions 64 and 65, the control instruction for forming a second reference mark Mb2 serving as a basis for acquisition of positional deviation amounts Gx and Gy at respective measurement positions Pk which are set at four corners of the recordable area 12*a* of the recording sheet 12. Then, upon receiving the recording timing signal PTS from the recording-timing generation circuit 61, the downstream head driving portion 65 allows the downstream head driver 54 to cause the downstream recording head 29 to eject black ink therefrom. At this time, when the recording sheet 12 is not expanded or contracted by the ejection of ink from the upstream recording head 28 to the recording sheet 12, the downstream head driving portion 65 forms the second reference marks Mb2 on the recording sheet 12 so as to overlap with the first reference marks Mb1 formed by the upstream recording head 28. Moreover, the second reference marks Mb2 are formed at positions of the recordable area 12*a* of the recording sheet 12 being located at positions where the clear ink has already been landed. Therefore, in the present embodiment, step S12 includes a second mark forming step. Here, "reference marks Mb1 and Mb2" are marks formed by first straight-line portions extending along the transport direction X and second straight-line portions extending along the width direction Y.

Thereafter, the control portion 56 outputs a control instruction to the scanner control portion 66 to scan the respective reference marks Mb1 and Mb2 formed at the respective measurement positions Pk of the recording sheet 12 by the respective recording heads 28 and 29 (step S13). Subsequently, the control portion 56 calculates a first positional deviation amount Gx in the transport direction X and a second positional deviation amount Gy in the width direction Y between the first reference mark Mb1 formed by the upstream recording head 28 and the second reference mark Mb2 formed by the downstream recording head 29 for each measurement position Pk based on the image information scanned by the scanner 18, as illustrated in FIG. 7B. Then, the control portion 56 calculates an average value of the respective first positional deviation amount Gx and an average value of the respective second positional deviation amount Gy and uses the calculation results as a first positional deviation amount Gx and a second positional deviation amount Gy on the recording sheet 12. Therefore, in the present embodiment, the control portion 56 also functions as an acquisition unit. Moreover, step S13 corresponds to a positional deviation amount detection step.

Subsequently, the control portion 56 outputs a control instruction to the image processing portion 58 and the recording-timing generation circuit 61 to correct the image data and the ink ejection timing based on the first positional deviation amount Gx and the second positional deviation amount Gy acquired in step S13 (step S14). Then, the image processing portion 58 moves recording dots formed by ink ejected from the downstream recording head 29 among the respective recording dots constituting the bitmap data expanded onto the memory portion 59 in the width direction Y by a distance corresponding to the second positional deviation amount Gy.

Specifically, among the recording dots based on the downstream recording head 29, regarding recording dots for which ink is to be landed on the positive Y side (the right side in FIG. 7A) of the center in the width direction Y, their ink landing positions are corrected to be moved toward the positive Y side of the recording sheet 12. On the other hand, regarding recording dots for which ink is to be landed on the negative Y side (the left side in FIG. 7A) of the center in the width direction Y, their ink landing positions are corrected to be moved toward the negative Y side of the recording sheet 12. Here, the movement amount (correction amount) of the recording dots increases as their ink landing positions are located closer to the end portion in the width direction Y of the recording sheet 12.

Moreover, the timing setting portion 72 of the recording-timing generation circuit 61 sets the second change time HT2 so that the ejection timing of ink from the downstream recording head 29 for the recording dots formed by the upstream recording head 28 is changed by a time corresponding to the first positional deviation amount Gx. Specifically, among the recording dots based on the downstream recording head 29, regarding recording dots for which ink is to be landed on the positive X side (the lower side in FIG. 7A) of the center in the transport direction X, the second change time HT2 is set to a negative time so that their ink landing positions are located on the positive X side of the recording sheet 12. On the other hand, regarding recording dots for which ink is to be landed on the negative X side (the upper side in FIG. 7A) of the center in the transport direction X, the second change time HT2 is set to a positive time so that their ink landing positions are located on the negative X side of the recording sheet 12. Here, the second change time HT2 of the recording dots has the larger absolute value as their ink landing positions are located closer to the end portion in the transport direction X of the recording sheet 12.

Thereafter, the control portion 56 calculates a consumption amount Q_color for each unit area, the consumption amount being obtained by subtracting the content of coloring material from a total consumption amount of various types of color ink (magenta ink and cyan ink) ejected from the upstream recording head 28 when recording images based on the image data received from the host computer 14 on the recording area 12*c* (an area surrounded by the one-dot chain line in FIG. 7A) of the recording sheet 12 (step S15). Specifically, the control portion 56 calculates an ejection amount of various types of color ink using the bitmap data (gradation value data) in which the recording dots (printing dots) converted by the image processing portion 58 are expressed in gradation values to thereby calculate the consumption amount Q_color for each unit area based on the sum of calculation results. Therefore, in the present embodiment, the control portion 56 also functions as a consumption amount calculation unit. Moreover, step S15 corresponds to a consumption amount calculation step. Here, the consumption amount Q_color is a total amount (corresponding value) of the moisture components among the total consumption amount of the various types of color ink ejected from the upstream recording head 28 when recording images on the recording sheet 12.

Subsequently, the control portion 56 calculates, for each unit area, an ejection amount (supply amount) Q_clear of the clear ink ejected onto the recordable area 12*a* when recording images on the recording area 12*c* of the recording sheet 12 (step S16). That is, the control portion 56 calculates the ejection amount Q_clear of the clear ink in respective portions of the recordable area 12*a* by subtracting the consumption amount Q_color of the color ink for each portion from a preset reference value (predetermined moisture content). Here, the reference value is a consumption amount per unit area when beta printing (recording by ejecting ink without leaving an empty space) is performed on the recording sheet 12.

Specifically, the control portion 56 calculates the ejection amount Q_clear of the clear ink so that the largest amount of clear ink is landed to portions of the recordable area 12*a* being located at positions where the color ink from the upstream recording head 28 is not landed. Moreover, the control portion 56 calculates the ejection amount Q_clear of the clear ink so that even at the same positions where the color ink from the upstream recording head 28 is landed, a larger amount of clear ink is ejected to portions where the landing amount of the color ink from the upstream recording head 28 is small, than to portions where the landing amount of the color ink is large. On the other hand, the control portion 56 calculates the ejection amount Q_clear of the clear ink so that a smaller amount of clear ink is ejected to portions where the landing amount of the color ink from the upstream recording head 28 is large, than to other portions. That is, in step S16, the ejection state (supply state) of the clear ink is set. Therefore, in the present embodiment, step S16 corresponds to a colorless liquid supply amount calculation step.

Subsequently, the control portion 56 outputs a control instruction to the upstream head driving portion 64, the control instruction for causing the upstream recording head 28 to eject ink therefrom (step S17). Then, the upstream head driving portion 64 controls the upstream head driver 53 to cause the upstream recording head 28 to eject magenta ink and cyan ink onto the recording area 12*c* of the recording sheet 12 while causing to eject clear ink to the recordable area 12*a* of the recording sheet 12. Therefore, in the present embodiment, step S17 corresponds to a first supply step.

Subsequently, the control portion 56 outputs a control instruction to the downstream head driving portion 65, the control instruction for causing the downstream recording head 29 to eject ink therefrom (step S18). Then, the downstream head driving portion 65 controls the downstream head driver 54 to cause the downstream recording head 29 to eject yellow ink and black ink to the recording area 12*c* of the recording sheet 12. Therefore, in the present embodiment, step S18 corresponds to second supply step. Thereafter, the control portion 56 ends the recording processing routine when the ink ejection by the respective recording heads 28 and 29 is completed. It is to be noted that the heater 17 is continuously controlled by the heater driving portion 63 when the recording processing routine is being executed. Therefore, the portions of the recording sheet 12 being located at positions where various types of ink are supplied by the upstream recording head 28 are heated by the heater 17. Therefore, the recording method according to the present embodiment includes a heating step.

Figure 8:
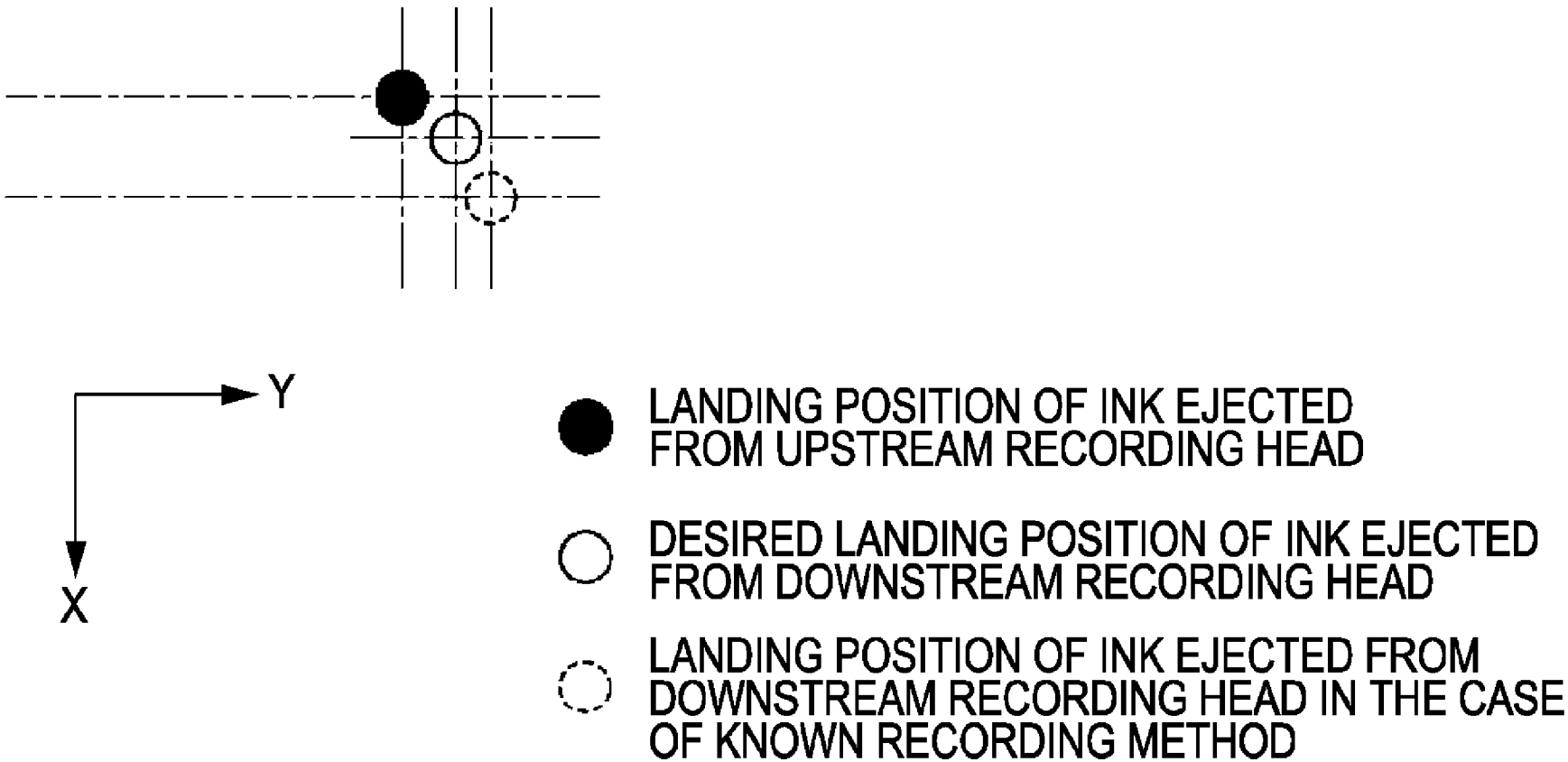
FIG. 8 is an operational diagram illustrating respective landing positions of ink ejected from corresponding recording heads.

In the known case where the correction process of step S14 is not performed, as illustrated in FIG. 8, the recording sheet 12 is expanded or contracted by ejection of ink from the upstream recording head 28 and heating by the heater 17, whereby the landing position of the ink ejected from the downstream recording head 29 is deviated from its original landing position in response to the degree of expansion/contraction of the recording sheet 12. To the contrary, in the present embodiment, prior to recording images on the recording sheet 12, by the use of a test recording sheet 12, the degree of expansion/contraction (namely, the respective positional deviation amounts Gx and Gy) of the recording sheet 12 resulting from the ink ejection from the upstream recording head 28 and the heating by the heater 17 is measured.

The downstream head driving portion 65 has a non-illustrated nozzle selection circuit that corrects (compensates) a positional deviation amount Gy upon receiving the positional deviation amount Gy to thereby select the nozzle opening 30 used for ejecting ink. Therefore, the positional deviation in the width direction Y is corrected by changing the nozzle opening 30 selected by the nozzle selection circuit. At this time, based on the selected nozzle opening 30, a correction instruction is output to the timing setting portion 72 so that the second change time HT2 is corrected in accordance with the nozzle arrays 32*a* to 32*e* to which the nozzle opening 30 belongs.

Moreover, in order to correct the positional deviation in the transport direction X, when ink is to be landed closer to the downstream side than the center in the transport direction X of the recording sheet 12, the ejection timing of the ink ejected from the downstream recording head 29 is moved forward. On the other hand, when ink is to be landed closer to the upstream side than the center in the transport direction X of the recording sheet 12, the ejection timing of the ink from the downstream recording head 29 is moved backward. As a result, the ink ejected from the downstream recording head 29 can be landed at an appropriate position of the recording sheet 12 with respect to the landing position of the ink ejected from the upstream recording head 28. That is, the positional deviation between the landing position of ink from the upstream recording head 28 and the landing position of ink from the downstream recording head 29 can be efficiently compensated.

Therefore, in the present embodiment, it is possible to obtain the following advantages.

(1) When the positional deviation amount Gx and Gy between the landing position of ink ejected onto the recording sheet 12 from the upstream recording head 28 and the landing position of ink ejected onto the recording sheet 12 from the downstream recording head 29 is obtained, the ejection state of ink by the downstream recording head 29 is adjusted. As a result, ink is ejected from the downstream recording head 29 to the recording sheet 12 in a state where the positional deviation amount Gx and Gy is corrected. Therefore, even when ink ejected from the upstream recording head 28 is absorbed in the recording sheet 12 and thus the recording sheet 12 is expanded or contracted, ink is ejected from the downstream recording head 29 toward a position corresponding to the landing position of ink ejected to the recording sheet 12 by the upstream recording head 28. Accordingly, even when a plurality of recording heads 28 and 29 capable of ejecting ink to the recording sheet 12 is arranged to be separated from each other in the transport direction X, it is possible to achieve an improvement in the quality of images recorded on the recording sheet 12.

(2) In step S12, an amount (i.e., predetermined amount Q_all) of ink corresponding to a total consumption amount of ink (color ink and clear ink) when actually recording images on the recording sheet 12 is ejected from the upstream recording head 28 to the recording sheet 12, and the positional deviation amount Gx and Gy is acquired in such a state. The ejection state of ink from the downstream recording head 29 is adjusted so that the thus acquired positional deviation amount Gx and Gy is corrected. Therefore, since the positional deviation amount Gx and Gy is acquired in a state where the moisture content absorbed in the recording sheet 12 is approximately equal to the moisture content absorbed in the recording sheet 12 when images are actually recorded, it is possible to acquire more accurate positional deviation amount Gx and Gy. Therefore, it is possible to achieve an improvement in the quality of images recorded on the recording sheet 12.

(3) In step S12, the reference marks Mb1 and Mb2 for each of the recording heads 28 and 29 are formed on the recording sheet 12. Moreover, the ejection state of ink from the downstream recording head 29 is adjusted based on the positional deviation amount Gx and Gy of each of the reference marks Mb1 and Mb2. That is, since the positional deviation amount Gx and Gy is acquired by using the special reference marks Mb1 and Mb2 for acquisition of the positional deviation amount Gx and Gy, it is possible to acquire the positional deviation amount Gx and Gy in an effective manner.

(4) The reference marks Mb1 and Mb2 have a shape formed by the straight-line portions extending along the transport direction X and the straight-line portions extending along the width direction Y. Therefore, by comparing the forming positions of the first reference marks Mb1 formed by the upstream recording head 28 and the forming positions of the second reference marks Mb2 formed by the downstream recording head 29 with each other, it is possible to acquire the positional deviation amount Gx in the transport direction X and the positional deviation amount Gy in the width direction Y in a more accurate manner.

(5) The clear ink is ejected onto an entire area of the recordable area 12*a* of the recording sheet 12 so that a landing amount of clear ink decreases as a landing amount of color ink from the upstream recording head 28 increases. Therefore, regardless of the images to be recorded on the recording sheet 12, the ejection amount of ink (color ink and clear ink) ejected from the upstream recording head 28 becomes equal as long as the size or the type of the recording sheet 12 is not changed. Accordingly, it is possible to easily adjust the ejection state of ink from the downstream recording head 29 which aims to correct the positional deviation amount Gx and Gy.

(6) From the downstream recording head 29, color ink (yellow ink or black ink) is ejected to portions of the recording area 12*c* of the recording sheet 12 being located at the same positions in the transport direction X as the positions where the clear ink is already ejected from the upstream recording head 28. That is, since the moisture absorption amounts (i.e., the amount obtained by subtracting the content of coloring material from the total amount of ink ejected to the recording sheet 12) are approximately equal at the positions in the transport direction X where the color ink is supplied from the downstream recording head 29, the degree of expansion/contraction at the respective positions in the transport direction X of the recording sheet 12 is approximately the same. Therefore, it is possible to unnecessitate the adjustment of the ejection state of ink from the downstream recording head 29 at each position in the transport direction X of the recording sheet 12, and thus to achieve simplification of the adjustment of the ink ejection state.

(7) The ink ejected to the recording sheet 12 from the upstream recording head 28 is vaporized by the heater 17 to some degree before the ejection of ink from the downstream recording head 29 is started. Therefore, it is possible to suppress blurring of the ink ejected from the upstream recording head 28 to the recording sheet 12 before the ink is ejected from the downstream recording head 29 to the recording sheet 12. Thus, it is possible to achieve an improvement in the quality of images recorded on the recording sheet 12.

(8) In the present embodiment, the test process in step S12 is not executed even when new image data are received unless the recording condition is changed. Therefore, compared with a case where the test process is executed whenever new image data are received, it is possible to achieve reduction in the number of test execution times. That is, it is possible to reduce the number of pages of the recording sheet 12 used in the test process.

The following modifications can be made to the above-described embodiment.

In the above-described embodiment, the test process may be executed whenever new image data are received. In such a case, the ejection state of the clear ink during the test process or the image recording is preferably set such that the moisture content for each unit area in the recordable area 12*a* of the recording sheet 12 becomes approximately equal to the moisture content in portions of the recordable area 12*a* where the landing amount of the color ink from the upstream recording head 28 when recording images is the largest. Owing to such a configuration, it is possible to achieve reduction in the ejection amount of the clear ink when recording images.

In the above-described embodiment, the positional deviation amount Gx and Gy may not be acquired through the test process but may be preliminarily set to a predetermined value.

In the above-described embodiment, the heater 17 may be disposed to be closer to the downstream side in the transport direction X than the downstream recording head 29. Moreover, the heater 17 disposed between the respective recording heads 29 may be omitted.

In the above-described embodiment, in the recording area 12*c* of the recording sheet 12, the color ink may be ejected when the ejection of the clear ink to the portions of the recordable area 12*a* other than the recording area 12*c* is completed.

In the above-described embodiment, the downstream recording head 29 may be configured to be unable to eject the clear ink.

Moreover, in the colorless liquid supply step, the clear ink may be ejected from the downstream recording head 29.

In the above-described embodiment, the recording apparatus 13 may be configured to include any number of recording heads equal to or greater than 3 being arranged along the transport direction X. For example, a recording head for magenta ink, a recording head for cyan ink, a recording head for yellow ink, and a recording head for black ink may be arranged in this order along the transport direction X. In such a case, the recording head disposed on the uppermost side and the recording head disposed on the lowermost side are preferably configured to be able to eject the clear ink. According to such a configuration, the color liquid supply step is executed in four sub-steps.

In the above-described embodiment, the scanner 18 may be disposed between the respective recording heads 28 and 29. In such a case, actual images formed by ejection of ink from the upstream recording head 28 may be acquired as recording information by the scanner 18 so that the positional deviation amount Gx and Gy is acquired based on a result of comparison between an actual size of the actual images resulting from the expansion/contraction of the recording sheet 12 and a desired image size. Here, "desired image size" means the size of images when it is assumed that the recording sheet 12 is not expanded or contracted by the ejection of ink from the upstream recording head 28.

In the above-described embodiment, in step S15, a total amount per unit area of the various types of color ink (magenta ink and cyan ink) ejected from the upstream recording head 28 when images are recorded on the recording area 12*c* of the recording sheet 12 may be used as the consumption amount Q_color. That is, the content of coloring material may not be taken into consideration.

Moreover, the consumption amount Q_color per unit area may be obtained by multiplying the total amount per unit area by a predetermined value (for example, "0.9"). Furthermore, a map or a relational formula representing the relation between the total amount per unit area and the consumption amount Q_color per unit area may be prepared in advance so that the consumption amount Q_color per unit area is obtained from the calculated total amount per unit area and the map (or relational formula).

As a correction method of the ejection state of the ink from the downstream recording head 29, a method of changing the ejection direction of ink from the nozzle openings 30 in accordance with the acquired positional deviation amount Gx and Gy may be used.

Moreover, as the correction method, the gradation values of the respective recording dots (printing dots) may be corrected in accordance with the acquired positional deviation amount Gx and Gy. By having such a configuration, the same advantages as the above-described embodiment can be obtained.

Furthermore, the same correction as the correction of the gradation values described above may be executed by the printer driver 40 of the host computer 14.

In the above-described embodiment, the ejection state of the ink from the upstream recording head 28 may be adjusted in accordance with the acquired positional deviation amount Gx and Gy. Moreover, when the ejection state of the ink from the upstream recording head 28 is adjusted, the ejection state of the ink from the downstream recording head 29 may not be corrected.

In the above-described embodiment, the above-described correction process may not be performed when recording images on a recording medium which is not expanded or contracted because ink has been supplied thereto.

In the above-described embodiment, one recording unit may have a configuration in which a plurality of recording heads each being smaller in size than the recording heads 28 and 29 of the above-described embodiment is arranged in a zigzag form.

Moreover, the recording heads 28 and 29 may be configured to be movable along the width direction Y. In such a case, the respective recording heads 28 and 29 individually eject ink while reciprocating along the width direction Y. However, when ink is being ejected from at least one of the respective recording heads 28 and 29, it may be preferable to temporarily stop the rotation of the transport motor 24.

In the above-described embodiment, the recording unit may have any configuration (for example, a configuration that ink is painted on the recording sheet 12) as long as it is capable of supplying ink to record images on the recording sheet 12.

In the above-described embodiment, the recording apparatus 13 may be configured to include one recording unit. In such a case, the transport mechanism 15 and the recording unit are preferably controlled so that after images are recorded on the recording area 12*c* of the recording sheet 12 using color ink, the clear ink is supplied to the recordable area 12*a* of the recording sheet 12.

In the above-described embodiment, the colorless liquid may be any liquid (for example, water) as long as it is colorless liquid.

In the above-described embodiment, the recording medium may be any recording medium (for example, plastic sheet) other than the recording sheet 12.

Although in the above-described embodiment, the recording apparatus is embodied in the ink jet recording apparatus 13, the invention is not limited thereto. The invention may be embodied in a recording apparatus that ejects or discharges liquid other than ink (including a liquid state material in which particles of functional material are dispersed or mixed, or a fluid state material such as gel). Moreover, the liquid as used in this specification includes not only an inorganic solvent, an organic solvent, a solution, liquid state resin, and a liquid state metal (metal melt), but also a liquid state material, and a fluid state material.

What is claimed is:

1. A recording method for recording images based on image data on a recording area of a recording medium using a first color liquid and a second color liquid containing coloring material and a colorless liquid not containing the coloring material, the recording medium being transported along a predetermined transport direction, the method comprising:

a consumption amount calculation step of calculating a consumption amount of the first color liquid consumed when recording the images based on the image data on the recording medium, the consumption amount being obtained by subtracting the content of the coloring material from a total consumption amount of the first color liquid, and the consumption amount being calculated for each unit area of the recording area of the recording medium;

a colorless liquid supply amount calculation step of calculating a difference between the consumption amount of the first color liquid calculated in the consumption amount calculation step for each unit area and a predetermined moisture content and using the difference as a supply amount of the colorless liquid for each unit area;

a first supply step of supplying the first color liquid corresponding to the consumption amount calculated in the consumption amount calculation step to the recording medium while supplying the colorless liquid corresponding to the supply amount calculated in the colorless liquid supply amount calculation step to the recording medium; and a second supply step of supplying the second color liquid to the recording medium after execution of the first supply step.

2. The recording method according to claim 1, further comprising a heating step of heating the recording medium to which the first color liquid and the colorless liquid are supplied in the first supply step, wherein in the second supply step, the second color liquid is supplied to a portion of the recording medium located at a position where the portion has been heated in the heating step.

* * * * *